US005471196A

United States Patent [19]

Pilested

[11] Patent Number: 5,471,196

[45] Date of Patent: Nov. 28, 1995

[54] SECURITY SYSTEM FOR SURVEILLING THE PASSAGE OF COMMODITIES THROUGH DEFINED ZONES

[76] Inventor: Karsten G. Pilested, No. 171, Skovdiget, DK-2880 Bagsværd, Denmark

[21] Appl. No.: 916,992

[22] PCT Filed: Feb. 19, 1991

[86] PCT No.: PCT/DK91/00048

§ 371 Date: Aug. 13, 1992

§ 102(e) Date: Aug. 13, 1992

[87] PCT Pub. No.: WO91/12598

PCT Pub. Date: Aug. 22, 1991

[30] Foreign Application Priority Data

Feb. 19, 1990 [DK] Denmark ..... 0433/90

[51] Int. Cl.[6] ..... G08B 13/14

[52] U.S. Cl. ..... 340/572; 455/83

[58] Field of Search ..... 340/572, 505, 340/825.14, 825.2; 455/77, 83; 343/745–748, 850

[56] References Cited

U.S. PATENT DOCUMENTS

| | | | |
|---|---|---|---|
| 3,584,301 | 6/1971 | Tomaszewski | 455/83 |
| 4,797,659 | 1/1989 | Larsen | 340/572 |
| 4,963,880 | 10/1990 | Torre et al. | 340/572 X |
| 5,036,308 | 7/1991 | Fockens | 340/572 |

FOREIGN PATENT DOCUMENTS

| | | |
|---|---|---|
| 0301127 | 2/1989 | European Pat. Off. . |
| 2362889 | 12/1973 | Germany . |
| 2426506 | 5/1974 | Germany . |
| 3717109 | 5/1987 | Germany . |
| 1408968 | 10/1975 | United Kingdom . |

OTHER PUBLICATIONS

Form PCT/IPEA/408 dated Dec. 4, 1991, relating to Pat. Application PCT/DK91/00048.

Patent Abstracts of Japan, vol. 10, No. 379, Abstract of JP 61–171233, Aug. 1986.

*Primary Examiner*—John K. Peng

*Assistant Examiner*—Thomas J. Mullen, Jr.

*Attorney, Agent, or Firm*—Sughrue, Mion, Zinn, Macpeak & Seas

[57] ABSTRACT

A security system for monitoring objects, for example commodities, which system comprises an antenna (7) with at least one tuning capacitor (1) in the monitored zone and receiver/transmitter devices functioning as tuned resonance circuits on the individual objects monitored, the antenna emitting at short intervals an electrical signal that makes the receiver/transmitter device of a monitored object, which is present in the monitored zone, oscillate, which oscillations in the intermissions between antenna (7) transmissions can be received by the antenna (7)—or by a separate antenna—and used to detect the presence of the monitored object in the monitored zone. A switch (3) is provided in the electrical circuit between the antenna (7) and the tuning capacitor (1).

2 Claims, 2 Drawing Sheets

SECURITY SYSTEM FOR SURVEILLING THE PASSAGE OF COMMODITIES THROUGH DEFINED ZONES

BACKGROUND OF THE INVENTION

The invention relates to a security system for surveilling the presence in defined zones such as, e.g. exit areas in shops or stores, of objects, for example commodities. The system comprises an antenna with at least one tuning capacitor in the monitored zone and receiver/transmitter devices functioning as tuned resonance circuits on the individual objects monitored, the antenna emitting at short intervals an electrical signal that makes the receiver/transmitter device of a monitored object, which is present in the monitored zone, oscillate, which oscillations in the intermissions between antenna transmissions can be received by the antenna—or by a separate antenna—and used to detect the presence of the monitored object in the monitored zone.

Such security systems are most typically used in shops and stores as a precaution against shoplifting, but may also be used in libraries to protect the books against theft. When an article has been sold or a book loaned, the receiver/transmitter device is removed from the article or book, respectively.

A problem inherent in such systems is that the antenna, which is a tuned circuit, unless special measures are taken, will continue oscillating for a short while into the intermission interval. It is then extremely difficult to distinguish between the residual signal of the antenna and a signal emitted by a monitored object.

In known systems of this kind attempts to solve the problem by shortcircuiting the antenna by the end of transmissions. Thereby, the energy stored in the antenna circuit is lost, but this requires a certain lapse of time, during which the antenna cannot receive possible reply signals from the receiver/transmitter device of a monitored object. During this lapse of time a very important part of the reply signal, which decreases exponentially, is lost, which has an unfortunate effect on the reliability of the monitoring process.

SUMMARY OF THE INVENTION

The object of the invention is to enhance the reliability of the monitoring process by minimizing, preferably eliminating said lapse of time during which the antenna is inactive.

This can be achieved according to the invention by means of a switch which at commencement of antenna intermissions electrically disconnects the functioning tuning capacitor from the antenna circuit to untune the antenna and thereby prevent it from storing energy.

Such a switch, which is electronic, may be a disconnector switch for disconnecting the electrical connection between the antenna and the tuning capacitor, for example by opening the circuit of the tuning capacitor to the antenna in the antenna circuit immediately by the end of transmissions or at commencement of same so that the antenna is untuned, either during intermissions or during transmissions. An untuned antenna cannot store energy. In both cases the detection of a reply signal can commence immediately at the start of intermissions.

From JP-A-171233 an antenna circuit for a radio telephone system is known, in which by means of an electronic switch an additional capacitor is connected in parallel with the tuning capacitor of the antenna to lower the tuning frequency of the antenna when the receiver is turned on.

The purpose of this circuit is to provide a shift of the antenna resonance frequency between the reception and transmission mode of the system.

This well-known form of changing the tuning of the antenna is not suitable, however, for security systems of the above-mentioned kind, such as anti-shoplifting systems, since in such systems a shift between two different tuning frequencies for the transmission and reception modes, respectively, would make the antenna insensitive to reception of reply signals produced by the passive receiver/transmitter devices and oscillating at the transmission frequency of the antenna.

BRIEF DESCRIPTION OF THE DRAWING

The invention is further explained in the following, by means of an exemplified embodiment with reference to the drawing, in which.

DESCRIPTION OF THE PREFERRED EMBODIMENT

Figure 1:
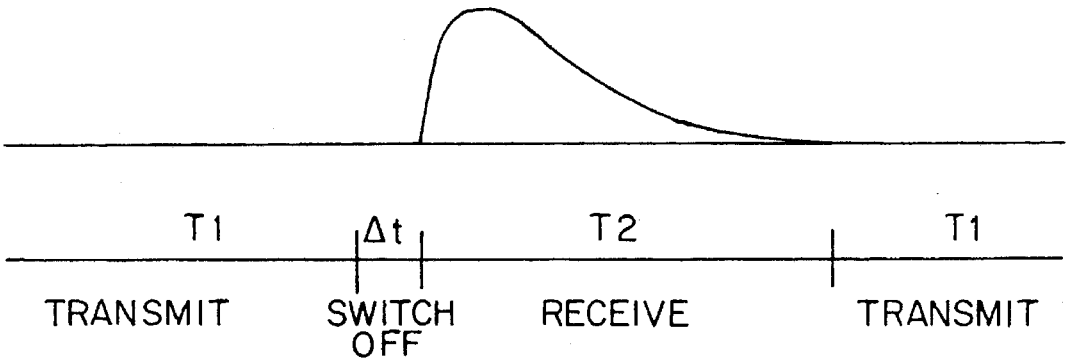
FIG. 1 PRIOR ART
FIGS. 1 and 2 show signal diagrams for a known system and a system according to the invention, respectively.

FIG. 1 shows the fraction of an exponentially decreasing reply signal from a monitored object which remains when shortcircuiting of the antenna in a known system ceases and detection of the signal can commence.

Figure 2:
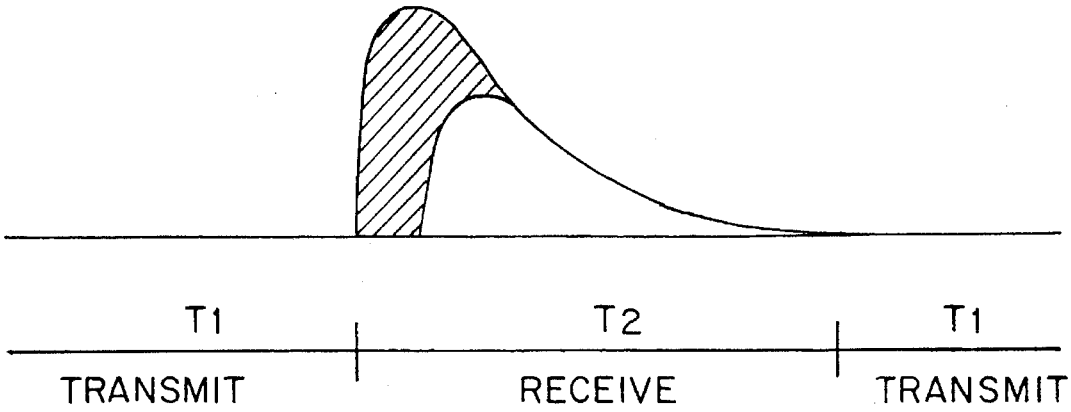

FIG. 2 shows the corresponding condition of the system according to the invention, in which the antenna is not shortcircuited, but the electrical connection between the antenna and the tuning capacitor totally cut off. The hatched area signifies the "additional signal" that is obtained as a result of the elimination of the lapse of time during which the antenna is inactive.

Figure 3:
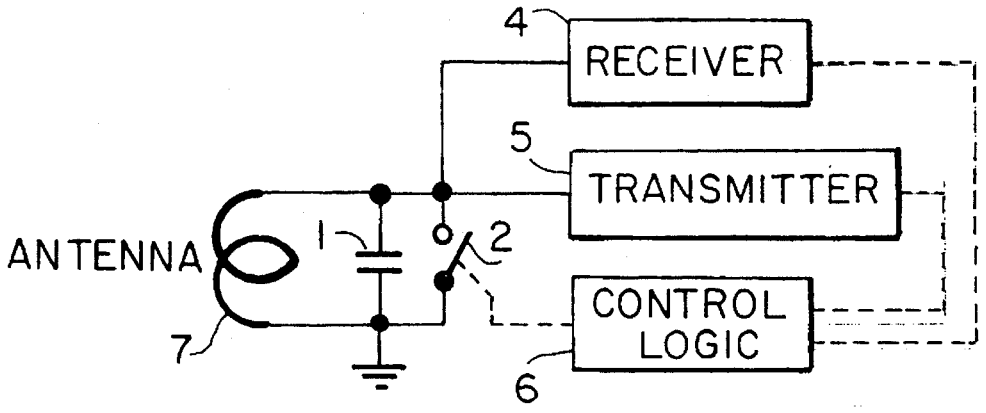
FIG.3 PRIOR ART
FIG. 3 is a schematic illustration of a known system.

FIG. 3 shows a known system, in which a transmitter 5 actuates the tuned antenna 7 at short intervals, controlled by a control unit 6. In the intervals (T2 in FIG. 1) between transmissions (T1 in FIG. 1) a possible reply signal from a monitored object must be detected. But prior to this, the energy which oscillates to and fro between the antenna 7 and the tuning capacitor 1, must be demolished, which in the known system takes place when the control unit 6 makes the switch 2 conducting, thereby short-circuiting the antenna 7. The energy stored in the antenna is thus demolished, but a short period lapses before detection of a reply signal by the receiver 4 can commence. During this lapse of time an important part of the reply signal is lost as illustrated in FIGS. 1 and 2.

Figure 4:
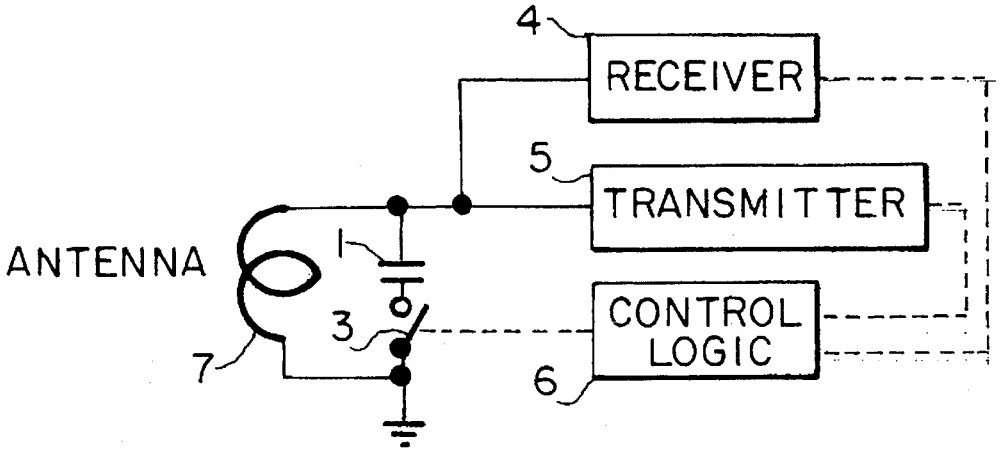
FIG. 4 is a corresponding schematic illustration of a system according to the invention.

In the embodiment shown in FIG. 4 of a security system according to the invention, a transmitter 5 likewise activates a tuned antenna 7 at short intervals, controlled by a control unit 6. But when a transmission period (T1 in FIG. 2) is terminated, the control unit 6 immediately electrically disconnects the capacitor 1. Thereby, the antenna becomes untuned and thus unable to emit a signal. This means that the entire intermission interval (t2 in FIG. 2) between two transmissions (T1 in FIG. 2) can be used to receive possible reply signals from a monitored object, as illustrated in FIG. 2.

I claim:

1. A security system for surveilling the presence of one or more objects in a monitored zone, said system comprising an antenna (7) and at least one tuning capacitor (1) in the monitored zone, a plurality of receiver/transmitter devices, each functioning as a tuned resonance circuit and being placed on respective ones of the one or more objects to be monitored, the antenna transmitting at short intervals an electrical signal that makes the receiver/transmitter devices, when present in the monitored zone, undergo oscillations which occur during intermissions between antenna (7) transmissions, said oscillations being received by the antenna (7) and used to determine the presence of the one or more objects in the monitored zone, and a switch (3) which temporarily electrically disconnects the at least one tuning capacitor from the antenna without short circuiting the antenna at commencement of each antenna (7) intermission to untune the antenna and thereby prevent it from storing energy.

2. A security system for surveilling the presence of one or more objects in a monitored zone, said system comprising an antenna (7) and at least one turning capacitor (1) in the monitored zone, a plurality of receiver/transmitter devices, each functioning as a tuned resonance circuit and being placed on respective ones of the one or more objects to be monitored, the antenna transmitting at short intervals an electrical signal that makes the receiver/transmitter devices, when present in the monitored zone, undergo oscillations which occur during intermissions between antenna (7) transmission, said oscillations being received by the antenna (7) and used to determine the presence of the one or more objects in the monitored zone, and a switch (3) connected in series with the at least one tuning capacitor (1) and which temporarily electrically disconnects the at least one tuning capacitor from the antenna without short circuiting the antenna at commencement of each antenna (7) intermission to untune the antenna and thereby prevent it from storing energy.

* * * * *